United States Patent [19]

Smith

[11] Patent Number: 5,064,192

[45] Date of Patent: Nov. 12, 1991

[54] EXERCISING INDICATOR

[76] Inventor: Arthur A. Smith, 6023 Cougar Dr., Knoxville, Tenn. 37921

[21] Appl. No.: 632,475

[22] Filed: Dec. 24, 1990

Related U.S. Application Data

[63] Continuation-in-part of Ser. No. 498,709, Mar. 26, 1990, abandoned.

[51] Int. Cl.[5] ..... A63B 23/00; A61B 5/08

[52] U.S. Cl. ..... 272/125; 272/93; 128/721

[58] Field of Search ..... 272/93, 125, DIG. 4, 272/DIG. 5; 128/721

[56] References Cited

U.S. PATENT DOCUMENTS 3,642,276 2/1972 Kropf .
4,296,757 10/1981 Taylor ..... 128/721
4,846,462 7/1989 Regnier et al. .
4,938,476 7/1990 Brunell et al. .
4,989,612 2/1991 Fore ..... 128/721

*Primary Examiner*—Richard J. Apley
*Assistant Examiner*—Glenn L. Richman
*Attorney, Agent, or Firm*—Pitts and Brittian

[57] ABSTRACT

A device for monitoring the exercising of body muscles or the like. The device has a body that is provided with a passageway from one side to the other through which can be passed any conventional belt-like member. Positioned within this passageway is a switch operator that is mounted so as to deform when increased tension is applied to the belt-like member. Upon adequate deformation, this operator causes a first switch contact to engage a second switch contact to complete a series electrical circuit containing both an audible and visual signal-generating unit. The spacing between the first and second switch contacts is adjustable by a user at any time, even while in use, to thus adjust the sensitivity of the device. The adjustment feature also provides an "on/off" switch for the device.

15 Claims, 2 Drawing Sheets

EXERCISING INDICATOR

This is a Continuation-in-Part application based upon parent application Ser. No. 07/498,709 filed on Mar. 26, 1990, now abandoned.

DESCRIPTION

1. Technical Field

This invention relates to devices used in conjunction with aerobics, isometrics and fitness exercising in general, and more particularly to a device for providing an audible and visual signal when a wearer thereof changes muscle stress during any of these types of exercises.

2. Background Art

As interest and participation in physical fitness, and exercises related thereto, continue to increase, so does the proliferation of devices designed to contribute to the effectiveness and enjoyment of this activity. There are many opinions regarding the best ways to lose weight or improve muscle tone. No one method seemingly is clearly better than the others as people report good results obtained from each of the systems. Some factors that provide strong influence on the choice of a personal exercise system include time, location and opportunity.

One effective method of exercise particularly suited to those with limited time, location and opportunity is the isometric exercise method. These exercises can be performed almost anywhere, anytime, by anyone, and consist of pushing or pulling relative to a fixed object so as to exercise one muscle or a set of muscles. Even flexing and holding of muscles can be effective. For instance, holding the stomach in a retracted position automatically causes the chest to be extended. This improves posture, expands the chest, flattens the stomach and helps improve breathing. Repeated performance of this exercise helps strengthen flabby muscles. Similar improvement of muscle tone and general health improvement can be achieved by periodic manipulation of muscles of the arm or leg, for example.

One aspect of isometrics is the determination of the degree of strenuousness of the particular exercise. This relates, in part, to the degree of muscle motion. Unless the motion exceeds a certain amount (for a particular person), the isometric exercise has little effect. Thus, there have been developed various devices to determine this degree of exercise. In the case of control of stomach muscles, it may be desirable to monitor any lack of continuous muscle action. For other isometrics, it may be desirable to monitor the repetitive motion of the muscles.

One such device is described in U.S. Pat. No. 3,642,276 issued to D. T. Kropf on Feb. 15, 1972. This device, which is attached to a special belt (or strap) provides for establishing a given tension therein through the use of a spring whose tension can be adjusted. Then when the belt moves an amount by overcoming this tension, an audible tone or signal is produced. Another device for a similar application is described in U.S. Pat. No. 4,846,462 issued to B. F. Regnier on July 11, 1989. This device, too, utilizes a special belt with one portion fastened to a component of the tension-determining portion and the other portion of the belt is fastened to a second component. These components are biased against movement away from each other with springs. However, when there is sufficient differential movement, an audible signal is produced. A third known device in this field is that described in U.S. Pat. No. 4,938,476 issued to T. R. Brunelle on July 3, 1990. This particular device senses a deviation from true vertical so as to monitor the degree of bending exercises. The principal component is a "level" switch that monitors a deviation from the vertical.

Thus, it can be seen that the devices of the prior art require, in particular, special belts or straps, and further are generally complex and relatively heavy.

Accordingly, it is an object of the present invention to provide a device for providing an indication to a user thereof of the degree of muscle stress achieved during isometric exercises.

It is another object of the present invention to provide an isometrics indicating device that is readily, and releasably, attached to any conventional belt or strap for engagement with a user.

A further object of the present invention is to provide a device for monitoring the degree of isometric exercise, or the lack thereof, for which the sensitivity of measurement can be easily changed by a user without disassembly thereof.

Also, it is an object of the present invention to provide an isometrics monitor that is light in weight, is inexpensive to construct, and requires essentially no maintenance.

These and other objects of the present invention will become apparent upon a consideration of the drawings referred to hereinafter and a complete description thereof.

DISCLOSURE OF THE INVENTION

In accordance with the present invention, there is provided a device for use during isometric exercises, and the like, to be releasably threaded upon any conventional belt (or strap) to be worn by a user that will emit an audible sound and/or visual signal when muscles beneath that belt move in a direction so as to increase tension on the belt. This device has an opening through which the belt is threaded. Positioned within this opening is an operator for one half of a set of switch contacts, this operator being deformable such that the first half of the switch moves toward the second half within the device by increased tension on the belt. The switch is electrically connected to an internal battery source and to an audible sound producing device which produces an intermittent sound. In the preferred embodiment, there is provided means for adjusting the sensitivity (and serving as an "on/off" switch) of the device, this means being operable from an exterior surface by a user of the device.

BEST MODE FOR CARRYING OUT THE INVENTION

Figure 1:
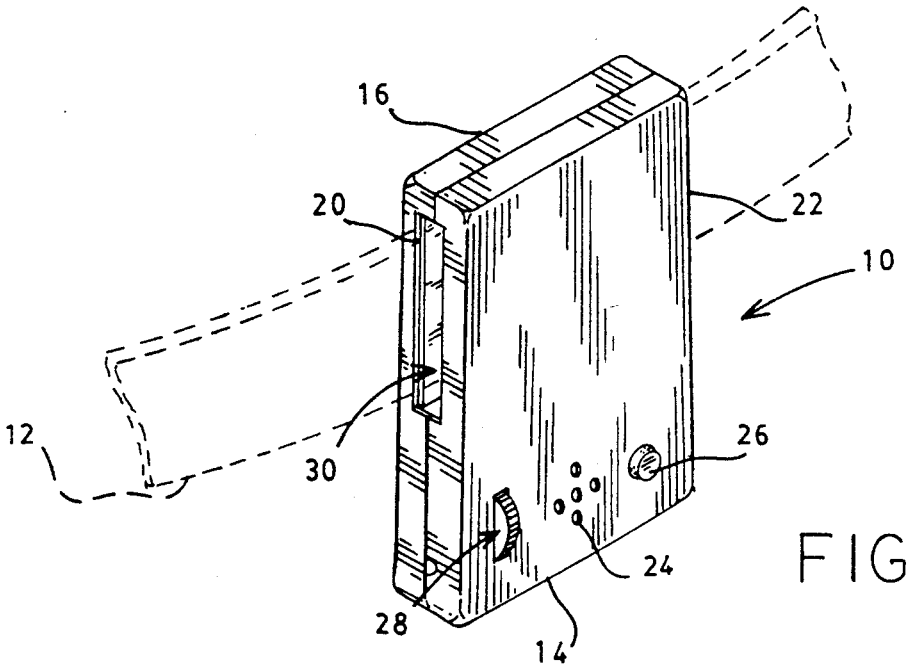
FIG. 1 is an isometric drawing of a device constructed in accordance with various features of the present invention and illustrating the device as carried on any conventional belt or strap.

A device for achieving the above-stated objects, and objects related thereto, is illustrated generally at 10 in FIG. 1. This is an isometric view of the device showing its installation on any suitable and conventional belt, strap, or the like 12. The body of the device is typically fabricated from a front body portion 14 and a rear body portion 16. These portions can be joined by any suitable means, as with a screw 18 (see FIG. 2). The two body portions are shaped with complementary notch configurations so as to jointly define generally rectangular openings 20, 22 through which the belt 12 is threaded. Thus, the device 10 can be positioned at any location along the belt 12. The front body portion is provided with openings 24 through which audible sound can escape. Also, there is a visible signal indicator 26 (see discussion of FIGS. 2 and 3) that is mounted in this front body portion. Furthermore, extending through this front body portion is a portion of a sensitivity adjustment means 28, this means being discussed in greater detail in connection with FIG. 4. Mounted within a passageway defined by the two openings 20, 22 is an operator 30 of the switch means of the device, this operator being moved according to tension of the belt 12, as described hereinafter.

Figure 2:
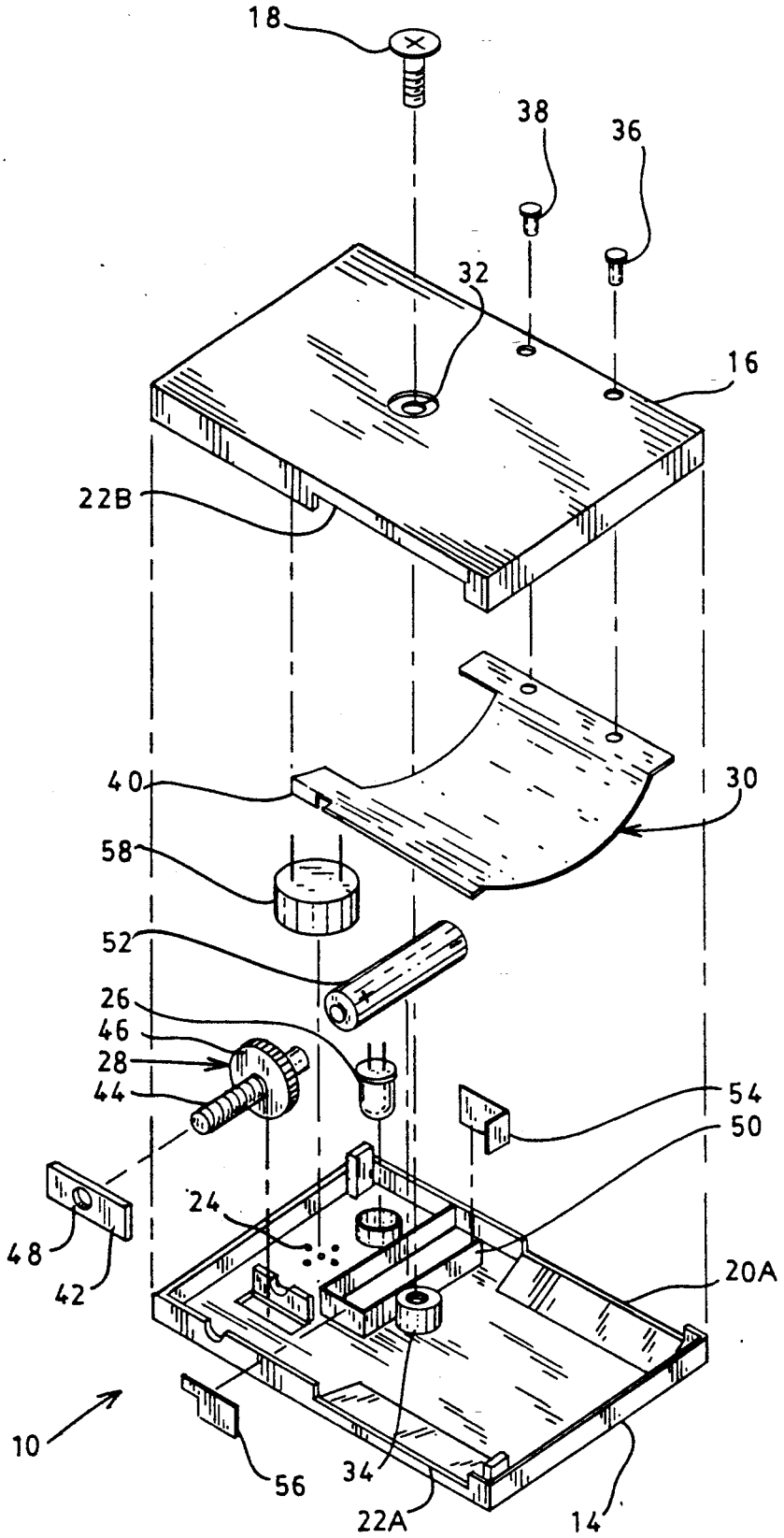
FIG. 2 is an exploded view of the device of FIG. 1 illustrating the switch portions, the battery and the electronic components contained within the device which give rise to signals according to the desired use of the device.

The various components of the present device 10 are more clearly evident in the exploded view of FIG. 2. It can be seen how the complementary notches 22A and 22B form the opening 22, and how notches 20A in the front body portion 14 and a complimentary notch in the rear body portion !6 form the opening 20. As stated above, the body portions 14, 16 are typically held together with a screw 18 that passes through a hole 32 in the back body portion 16 to be received in a boss 34 as part of the front body portion 14. Of course, the screw could be oriented in the reverse direction, if desired, or the two body portions could be joined by any other suitable means.

Figure 4:
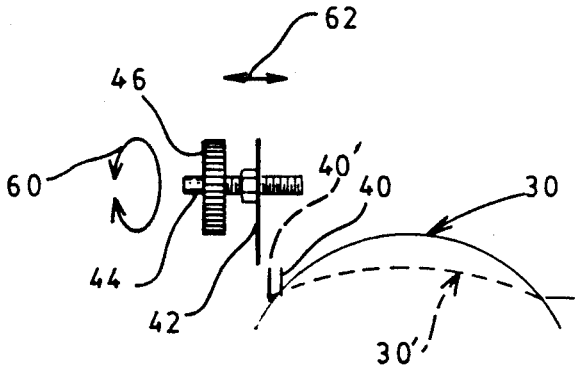
FIG. 4 is a schematic diagram illustrating the operation of the switch portions of the device of FIG. 1 together with the operation of the sensitivity adjustment means of the device.

In the embodiment illustrated, the switch operator 30 is an arcuately-shaped body having one edge thereof fastened to the back body portion 16 as with rivets 36, 38. The opposite edge of this switch operator is unsupported, and is formed to produce a first switch contact surface 40. Any belt or like device that is threaded through the openings 20, 22 bears against the surface of this switch operator 30, and increased tension of the belt, etc. results in a deformation of the switch operator toward the back body portion; however, since movement in that direction is limited, the first switch contact surface 40 is moved laterally as shown in FIG. 4.

Positioned within the cavity formed between the front and rear body portions 14, 16 is a second switch contact 42. In the preferred form of the invention, the position of this second switch contact 42 can be adjusted using the sensitivity adjusting means 28. This adjusting means includes a rotatable threaded shaft 44, a thumb wheel 46, a portion of which projects through the front body portion 14 as shown in FIG. 1, and a travelling nut 48 to which the second switch contact is attached.

The body cavity also contains a battery case 50 and a battery 52. This is typically a twelve volt battery, type GR23A, such as Radio Shack Part No. 23-144. Battery contacts 54, 56 are positioned within the battery case 50 in a normal manner. In addition, the cavity contains a audible sound-producing device 58 which is typically a piezo buzzer with a built-in driver circuit operating at 4.2 kHz. Such a device is Radio Shack Part No. 273-074. This buzzer is used in conjunction with a blinking light emitting diode (BLED) 26 with a built-in timing circuit, such as Radio Shack Part No. 276-036, that operates at a frequency of 2 Hz.

Figure 3:
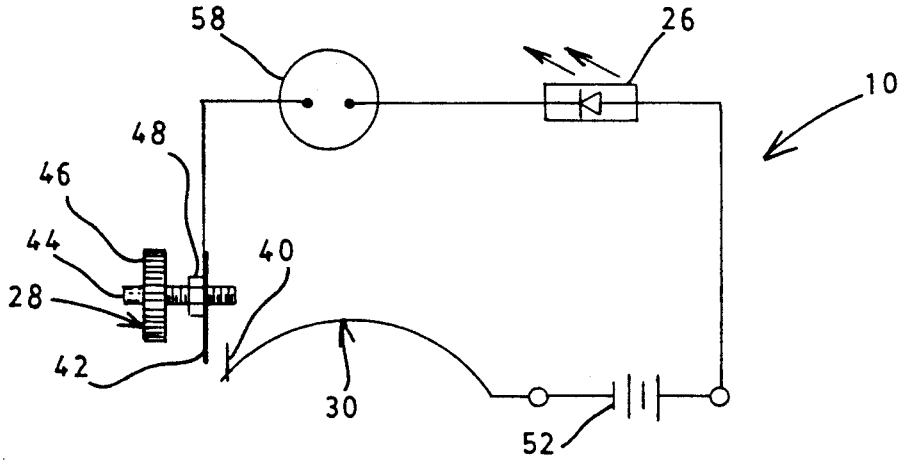
FIG. 3 is a schematic electrical diagram of the device of FIG. 1.

A schematic circuit diagram of the present invention is shown in FIG. 3 It can be seen that the battery 52, the BLED 26 and the piezo buzzer 58 are connected in series with the two switch components 40 (as part of operator 30), 42 At most settings of the sensitivity adjusting means 28, the switch part 40 can be brought into contact with its counterpart switch portion 42 when the operator 30 is sufficiently deformed as by increased tension of a belt (12) against the convex surface thereof. However, if the switch portion 42 is sufficiently displaced by the sensitivity adjusting means 28, even extensive deformation of the switch operator 30 will not bring contact surface 40 into contact with switch contact 42. Thus, the device will be turned "off". This causes the sensitivity adjusting means 28 to also be an "on/off" switch for the device.

FIG. 4 illustrates a portion of the schematic diagram of FIG. 3 to permit a full understanding of the operation of the switch components 40, 42 and the sensitivity adjusting feature of the present invention. As illustrated by the solid lines, this is a condition when there is little if any tension on a belt in contact with the convex surface of the switch operator 30. When in this condition, contact 40 is separated from contact 42 and no signal (either audible or visual) is created. However, when the switch operator 30 is deformed to the position indicated at 30', the two switch contacts are brought together to complete the electrical circuit from the battery to the audible and visual signal indicators (58 and 26, respectively). The amount of deformation required of the operator 30 before contact is made is adjustable by the means 28. This adjustment is accomplished by rotation of the thumbwheel 46 as indicated by the arrow 60. This causes the travelling nut 48 to move along the shaft 44 in a direction as indicated by the double headed arrow 62. Since the switch contact 42 is carried by the travelling nut, the spacing between contact 42 and contact 40 is adjusted which controls the distance the contact 40 must travel to contact the second contact 42, i.e., the sensitivity of the device is adjusted.

The device of the present invention can be utilized in numerous ways. For example, a waist-encircling belt of a user can be threaded through the passageway in the body where it typically loosely contacts the convex surface of the switch operator 30. By tightening the belt, and without drawing in the stomach muscles, sufficient tension is applied to the belt such that the operator 30 is deformed sufficiently so as to bring switch contact 40 against switch contact 42. This completes the electrical circuit causing the various signals to be generated. Since the BLED has a switching circuit as part thereof, both the light and the piezo buzzer will give signals that are intermittent. Then, when the stomach muscles are tensed, which improves posture, the tension in the belt is reduced and the signals turn off. As will be understood, the sensitivity adjusting means 28 permits selection of the point at which the signals will be generated (and turned off). This adjustment is easily made by a user through the rotation of the thumbwheel 46, even while in use. When used in this way, the device provides for monitoring of stomach muscle exercising under controlled conditions. Also, this application of the device will serve as a monitor to a user as to a correct posture with the stomach muscles contracted.

The device can further be used to monitor the muscle movement of other parts of the body where an encircling belt or strap can be threaded through the device. Thus, exercise of the muscles of parts of the arm and the leg, for example, can be monitored.

From the foregoing it will be understood by a persons skilled in the art that an improved device is provided for monitoring muscle motion and/or position. This device does not require any special belt-like member so that it can be adapted to conventional apparel of a user. The device is simple to construct and thus is inexpensive and has few parts that will need replacement. The sensitivity of the device can be readily adjusted at any time by a user without removal from the user's body, and this sensitivity adjustment can also be used as an "on/off" switch for the device.

It will be recognized that although the primary intended use of the present invention is in connection with health matters, the device can be used in conjunction with any type of belt-like structure where the tension thereof is to be monitored.

Although specific components have been enumerated in conjunction with a description of the present invention, these are given for illustration purposes and not for a limitation of the invention. Rather, the invention is to be limited only by the appended claims or their equivalents.

I claim:

1. A device for monitoring body muscle movement, said device to be installed upon a conventional belt-like member to encircle a portion of a user's body where said muscle movement is to be monitored, which comprises:

a housing member, said housing member provided with a passageway for receiving said belt-like member therethrough;

a switch operator positioned with passageway, said switch operator having a contoured surface for contact with said belt-like member, said switch operator having one edge thereof fixed within said housing member and an opposite edge movable upon pressure being applied to said contoured surface by said belt-like member as said belt-like member is tensioned by said muscle movement, said switch operator having a first electrical switch contact;

a second electrical switch contact positioned within said housing member and aligned for engaging said first switch contact;

a source of electrical current positioned within said housing member;

an intermittent light producing member positioned in said housing member and visible from exterior said housing member;

an audible intermittent sound producing member positioned within said housing member;

circuit means within said housing member connecting, in series, said source of electrical current, said intermittent light producing member, said audible sound producing member, said first switch contact and said second switch contact; and means for adjusting spacing between said first switch contact and said second switch contact, said means for adjusting spacing including actuating means therefor that at least partially extends exterior said housing member.

2. The device of claim 1 wherein said intermittent light producing member is a blinking light emitting diode including a built-in timing circuit;

3. The device of claim 1 wherein said intermittent sound producing member is a piezo buzzer including a built-in driver circuit.

4. The device of claim 1 wherein said source of current is a d.c. battery.

5. The device of claim 1 wherein said means for adjusting spacing between said first and second switch contacts comprises:

a rotatable shaft member within said housing member, said shaft member having exterior threads;

a thumbwheel attached to said rotatable shaft member whereby rotation of said thumbwheel by a user of said device rotates said shaft member; and a travelling nut member threadably engaged with said treads of said shaft member whereby rotation of said shaft member causes said travelling nut member to move axially along said shaft member, said second switch contact being attached to said travelling nut member whereby movement of said travelling nut member causes movement of said second switch contact relative to said first switch contact.

6. The device of claim 1 wherein said switch operator has a substantially convex contoured surface for engaging said belt-like member.

7. The device of claim 1 wherein said means for adjusting spacing between said first and second switch contacts is an "on/off" switch means for said device.

8. The device of claim 1 wherein said housing member comprises:

a front body portion, said front body portion provided with apertures proximate said sound producing member, with an aperture proximate said light producing member, and with an opening to receive said at least one portion of said means for adjusting spacing between said first and second switch contacts; and a rear body portion for attachment to said front body portion;

wherein said front body portion and said rear body portion are provided with complementary notches to form said passageway through said housing member.

9. A device for monitoring body muscle movement, said device to be installed upon a portion of a user's body where said muscle movement is to be monitored, which comprises:

a housing member, said housing member provided with a passageway for receiving said belt-like member therethrough;

a switch operator positioned within said passageway, said switch operator having a convex contour surface for contact with said belt-like member, said switch operator having one edge thereof fixed within said housing member and an opposite edge movable upon pressure being applied to said convex contoured surface by said belt-like member as said belt-like member is tensioned by said muscle movement, said switch operator having a first electrical switch contact;

a second electrical switch contact positioned within said housing member and aligned for engaging said first switch contact;

a d.c. battery for providing a source of electrical current positioned within said housing member;

a blinking light emitting diode with a built-in timing circuit positioned in said housing member and visible from exterior said housing member;

a piezo buzzer with a built-in driver circuit for producing intermittent sound positioned within said housing member;

circuit means within said housing member connecting, in series, said battery, said blinking light emitting diode, said piezo buzzer, said first switch contact and said second switch contact; and means for adjusting spacing between said first switch contact and said second switch contact, said means for adjusting spacing including actuating means therefor that at least partially extends exterior said housing member.

10. The device of claim 9 wherein said means for adjusting spacing between said first and second switch contacts comprises:

a rotatable shaft member within said housing member, said shaft member having exterior threads;

a thumbwheel attached to said rotatable shaft member whereby rotation of said thumbwheel by a user of said device rotates said shaft member; and a travelling nut member threadably engaged with said treads of said shaft member whereby rotation of said shaft member causes said travelling nut member to move axially along said shaft member, said second switch contact being attached to said travelling nut member whereby movement of said travelling nut member causes movement of said second switch contact relative to said first switch contact.

11. The device of claim 9 wherein said means for adjusting spacing between said first and second switch contacts is an "on/off" switch means for said device.

12. A device for monitoring body muscle movement, said device to be installed upon a conventional belt-like member to encircle a portion of a user's body where said muscle movement is to be monitored, which comprises:

a housing member, said housing member provided with a passageway for receiving said belt-like member therethrough;

a switch operator positioned within said passageway, said switch operator having a convex contour surface for contact with said belt-like member, said switch operator having one edge thereof fixed within said housing member and an opposite edge movable upon pressure being applied to said convex contoured surface by said belt-like member as said belt-like member is tensioned by said muscle movement, said switch operator having a first electrical switch contact;

a second electrical switch contact positioned within said housing member and aligned for engaging said first switch contact;

a d.c. battery for providing a source of electrical current positioned within said housing member;

a blinking light emitting diode with a built-in timing circuit positioned in said housing member and visible from exterior said housing member;

a piezo buzzer with a built-in driver circuit for producing sound positioned within said housing member;

circuit means within said housing member connecting, in series, said battery, said blinking light emitting diode, said piezo buzzer, said first switch contact and said second switch contact;

a rotatable shaft member within said housing member, said shaft member having exterior threads;

a thumbwheel attached to said rotatable shaft member, at least a portion of said thumbwheel being exterior to said housing member, whereby rotation of said thumbwheel by a user of said device rotates said shaft member; and a travelling nut member threadably engaged with said treads of said shaft member whereby rotation of said shaft member causes said travelling nut member to move axially along said shaft member, said second switch contact being attached to said travelling nut member whereby movement of said travelling nut member causes movement of said second switch contact relative to said first switch contact.

13. The device of claim 12 wherein rotation of said thumbwheel moves said second switch contact to a position such that no engagement with said first switch contact occurs when said switch controller is deformed by said belt-like member whereby said device is in an "off" condition.

14. The device of claim 12 wherein said housing member comprises:

a front body portion, said front body portion provided with apertures proximate said sound producing member, with an aperture proximate said light producing member, and with an opening to receive said at least one portion of said means for adjusting spacing between said first and second switch contacts; and a rear body portion for attachment to said front body portion;

wherein said front body portion and said rear body portion are provided with complementary notches to form said passageway through said housing member.

15. The device of claim 12 wherein said driver circuit includes a blinking LED which serves as a time to intermittently interrupt the piezo buzzer thereby producing an intermittent sound.

* * * * *